US006350219B1

(12) United States Patent
Hobson

(10) Patent No.: US 6,350,219 B1
(45) Date of Patent: Feb. 26, 2002

(54) VARIABLE RESISTANCE EXERCISE MACHINE

(75) Inventor: Tyler J. Hobson, Montgomery, TX (US)

(73) Assignee: Pendulum Fitness, Inc., Montgomery, TX (US)

( * ) Notice: Subject to any disclaimer, the term of this patent is extended or adjusted under 35 U.S.C. 154(b) by 0 days.

(21) Appl. No.: 09/346,476

(22) Filed: Jul. 1, 1999

(51) Int. Cl.[7] ..... A63B 21/08
(52) U.S. Cl. ..... 482/97; 482/100; 482/137
(58) Field of Search ..... 482/97, 137, 100, 482/80, 98, 104, 136, 138, 908; D21/675, 673

(56) References Cited

U.S. PATENT DOCUMENTS

| | | | | | |
|---|---|---|---|---|---|
| 684,688 | A | | 10/1901 | Herz | |
| 1,007,526 | A | * | 10/1911 | Caro | 601/33 |
| 2,855,199 | A | * | 10/1958 | Noland et al. | 482/97 |
| 3,475,024 | A | | 10/1969 | Lewis | |
| 3,558,130 | A | | 1/1971 | Anderson | |
| 3,856,297 | A | * | 12/1974 | Schnell | 482/97 |
| 4,256,302 | A | | 3/1981 | Keiser et al. | |
| 4,509,746 | A | | 4/1985 | Mask | |
| 4,614,338 | A | * | 9/1986 | Castillo | 482/98 |
| 4,621,810 | A | | 11/1986 | Cummins | |
| 4,627,619 | A | | 12/1986 | Rockwell et al. | |
| 4,795,149 | A | * | 1/1989 | Pearson | 482/98 |
| 4,834,396 | A | * | 5/1989 | Schnell | 482/97 |
| 4,854,578 | A | * | 8/1989 | Fulks | 482/97 |
| 4,884,801 | A | * | 12/1989 | Schnell | 482/97 |
| 5,050,868 | A | * | 9/1991 | Pearson | 482/94 |
| 5,050,873 | A | | 9/1991 | Jones | |
| 5,058,884 | A | | 10/1991 | Fuller, Sr. | |
| 5,106,080 | A | | 4/1992 | Jones | |
| 5,135,449 | A | | 8/1992 | Jones | |
| 5,184,991 | A | | 2/1993 | Brangi | |
| 5,358,462 | A | | 10/1994 | Calderone | |
| 5,769,757 | A | | 6/1998 | Fulks | |

OTHER PUBLICATIONS

Hammer Strength Product Information Guide, Mar. 1998, pp. 1–12.
Life Fitness Brochure, 1997, all pages.

* cited by examiner

*Primary Examiner*—Mickey Yu
*Assistant Examiner*—Victor K. Hwang
(74) *Attorney, Agent, or Firm*—Natalie J. Spahr; Keith B. Willhelm

(57) ABSTRACT

An exercise machine includes a frame, a removable seat, and a shaft horizontally mounted on the frame, which rotates about its longitudinal axis. Attached to the shaft is at least one weight arm and at least one work arm. The work arm can be releasably connected and take multiple forms, each adapted for particular exercises. When an exerciser pulls or pushes on the work arm, the shaft rotates and carries the weight arm in an arc from a starting or first position to a second position. Because the weight arm travels in an arc, the resistance to the exerciser varies over the course of the exercise. Further, the starting or first position of the weight arm may be adjusted to change the starting resistance to the exerciser.

9 Claims, 2 Drawing Sheets

VARIABLE RESISTANCE EXERCISE MACHINE

This invention relates to an improved variable resistance exercise machine adapted to perform multiple exercises that accommodate the musculoskeletal makeup of a person.

BACKGROUND OF THE INVENTION

Many persons utilize weight training to develop strength, to enhance their personal appearance, or for rehabilitation. Weight training can be accomplished through the use of weight machines and/or free weights, i.e., dumbbells, barbells, and weighted plates. Both types of weight training have advantages and disadvantages.

Free weights are generally more inexpensive and more versatile than weight or exercise machines. One set of free weights can be used to work many different muscle groups. Free weights also offer an improved range of motion over exercise machines, which are restricted to one plane of movement. The primary disadvantage of free weights is safety. Because free weights are not restricted in their range of motion, an exerciser could drop a weight on him/herself, the bar could fall on an exerciser when weighted plates are being added or removed, or an exerciser could be trapped underneath a weighted bar. Because of these safety risks, most exercisers have to work out in pairs or specialized facilities to protect themselves. This also limits the exerciser to times and places where they can work out.

Because of these disadvantages relating to free weights, exercise machines have become more common. These machines offer improved safety because the weights are usually restricted to one plane of motion. This prevents a weight from falling on an exerciser. Further, this restricted range of motion only allows a bar to return to an initial starting position, which prevents an exerciser from being pinned underneath a bar. Exercise machines also improve safety because the machine's frame prevents any imbalance during the addition or removal of weights. In fact, some machines come with all of the weights already equipped on the machine such that the weight can be changed by moving a pin.

Although exercise machines offer improved safety over free weights, they also have disadvantages. The primary disadvantage of exercise machines is that they are usually designed to provide only one exercise. For the machines that provide more than one exercise, the cost usually increases proportionately with the additional exercises offered by a single machine. Thus, it is very expensive to own machines that allow exercise of different muscle groups, especially for individual owners.

The prior art has countless disclosures relating to exercise machines or apparatuses designed for improving the muscle characteristics of differing muscle groups. Most of these machines use cables, pulleys or levers to carry a weight over a restricted range of motion. For example, U.S. Pat. No. 5,135,449 discloses a rowing exercise machine. This machine uses a pair of levers to provide the resistance to an exerciser. This machine is only suited to provide one exercise. Another example, U.S. Pat. No. 5,184,991, discloses a multi-station exercise machine for exercising different muscle groups, which uses pulleys and levers. It should be noted that this apparatus requires the exerciser to move to different locations on the apparatus to carry out the different exercises. Accordingly, a major problem of exercise machines is to provide a variety of exercises in a compact machine that can be performed from substantially the same location on the machine.

Many exercise machines are also difficult and costly to build. Many machines use a series of levers, pulleys, cables, or other specialized components. These specialized components increase the complexity of the design and the time to assemble the machines. Moreover, the cost to build and replace these parts is relatively high when compared with machines that do not require these components. Thus, machines that use specialized components are more difficult to manufacture and maintain and are more expensive than other exercise machines.

Another problem is that free weights and some exercise machines on the market today are not designed to provide a variable resistance workout to the exerciser. By variable resistance I mean a change in the force that is needed to move a given (predetermined) weight over a range of motion. The advantage of using variable resistance in weight training is that it allows for a more efficient workout by causing muscle groups to work hardest at a specified range of motion. Variable resistance also helps to prevent injury by allowing an exerciser to exert less force at vulnerable points in a range of motion during an exercise. For example, when conducting a squat, the exerciser is at risk of back injury when first picking up a weight from the lowest position. Variable resistance would allow the exerciser to initially lift the weight with less force at this vulnerable position. Then, as the exerciser continues on the range of motion in the squat, the force necessary to move the weight would increase. By using variable resistance during a work out, an exerciser can better isolate specific muscle groups and avoid injury to others. Most exercises that utilize free weights and exercise machines do not provide variable resistance. Instead the force that an exerciser must exert is substantially constant over the entire range of motion.

An object of the invention, therefore, is to provide a variable resistance exercise machine.

Another object of the invention is to provide a safe exercise machine that has a restricted range of motion and allows an exerciser to work out without the aid from others.

It is a further object of the invention to provide an exercise machine that provides a variety of exercises that can be substantially carried out from one location on the machine.

Another object of the machine is to allow an exerciser to work out in less space.

A further object of the invention is to provide a machine that is more easily manufactured and assembled.

Still a further object of the invention is to provide an exercise machine that provides a variety of exercises that is less costly to manufacture and more affordable to the exerciser.

It is a further object of this invention to provide an exercise machine wherein some or all of the above-mentioned advantages are realized.

These and other objects and advantages of the invention will be apparent to those skilled in the art upon reading the following detailed description and upon reference to the drawings.

SUMMARY OF THE INVENTION

The subject invention contemplates a variable resistance exercise machine having a support frame, a rotatable shaft, a pair of weight arms, a work arm, and at least one weight arm support. The shaft is horizontally mounted in a fixed, predetermined position on the support frame for rotation about its longitudinal axis. The pair of weight arms are connected to and extend from the shaft at opposite ends thereof in a direction substantially perpendicular to the longitudinal axis of the shaft. Each of the weight arms has a weight hub for carrying at least one weight at a point distant from their respective connections to the rotating shaft.

The work arm is connected to and extends from the shaft at a point intermediate of and spaced from the connections between the weight arms and the shaft. The work arm is adapted to be actuated by an exerciser, whereby the weights are moved in arcuate paths relative to the longitudinal axis of the shaft from respective first positions to second positions. Thereby, the resistance to rotation provided by the weight arms also varies as the weight arms travel in an arcuate direction.

The weight arm support selectively supports at least one of the weight arms in a substantially non-vertical position. It prevents rotation of the shaft in a direction such that the supported weight arm would become oriented in a substantially downward, vertical position and permits free rotation of the shaft in a second direction away from the support.

In preferred aspects, the sides of the frame of the machine are substantially U-shaped, with a first half equipped for mounting an adjustable and removable seat, and a second half open for performing exercises which require the exerciser to stand, such as squats and dead lifts. The second half is also adapted to support the rotating shaft, preferably mounted by pillow block bearings. Thus, the seat is supported by the frame behind the shaft. When an exerciser is seated on the machine, he will usually be facing the rotating shaft. However, the seat can be removed to provide space for other exercises, such as leg press.

The work arm can be releasably connected to the shaft via adjustable receivers, and may take many forms so as to facilitate different types of exercises. For example, the work arm can be adapted to perform at least the following exercises: lat pull down, military press, chest press, tricep extension, seated dips, bicep curl, low row, lying leg press, squats, dead lifts, abdominal crunches, leg extension, seated leg curl, lat pull over, etc. The weight arm can be adapted to hold at least one removable weight, usually in the form of a plate, such as would be added to a free weight bar. The frame will provide the support necessary to balance the machine, specifically the rotating shaft, to keep the weights and shaft in place.

In accordance with the objects of the invention, when an exerciser is seated facing the shaft, the work arm can be actuated from this single position so that the exerciser can perform different exercises which require either pushing the work arm away from the exerciser, or pulling to work arm toward the exerciser. Thus, the work arm can be actuated by an exerciser causing the shaft to rotate in a clockwise or a counter-clockwise direction. This feature, in addition with the interchangeable work arms, allows the machine to provide many different exercises with the exerciser at substantially the same location on the machine.

Further, because the exerciser's range of motion is restricted, the machine provides increased safety and allows an exerciser to work out alone.

Further, because the machine does not require pulleys, or cables, the machine is relatively inexpensive to manufacture and assembly is easy and efficient. Thus, the machine provides a variety of exercises at decreased cost to the exerciser.

The exercise machines function as follows: as the exerciser pushes or pulls the work arm, the shaft will rotate, causing the weight arm to travel in an arcuate direction from a starting or first position to a second position. As the weight arm moves in an arcuate direction, the resistance to rotation by the weight arm varies. The starting resistance is that resistance that the exerciser feels when the exerciser first begins to pull or push the work arms. When the weight arm has a substantially vertical starting position, the starting resistance provided by the weight arm is substantially zero. Then, as an exerciser pulls the work arms, the weight arms will travel to a second position counterclockwise of the starting position. At this substantially vertical starting or first position, the resistance to the exerciser is virtually zero. As the exerciser pulls the work arm toward themselves, the weight arm gains increased resistance as it approaches a substantially horizontal position in the counterclockwise direction. The force required to actuate the work arm also increases over this range of motion. Then, as the weight arm travels from this substantially horizontal position to a substantially vertical position, the resistance decreases. Thus, the resistance to the exerciser varies as the weight arm is carried along its arcuate path. Alternatively, the second position can be clockwise of the starting or first position.

The machine has a means for supporting the weight arms in one or more substantially non-vertical positions to adjust the starting resistance provided by the weight arm. Thus, the weight arm can have a substantially non-vertical starting position, whereby the starting resistance provided by the weight arm is greater than zero. Also, the first position of the weight arm may be selected to adjust the starting resistance provided by the weight arm. Thus, in accordance with the objects of the invention, the exercise machine provides variable resistance to the exerciser.

These and other features of the invention will be more readily understood in view of the following detailed description and drawings.

DESCRIPTION OF ILLUSTRATIVE EMBODIMENTS

Figure 1:
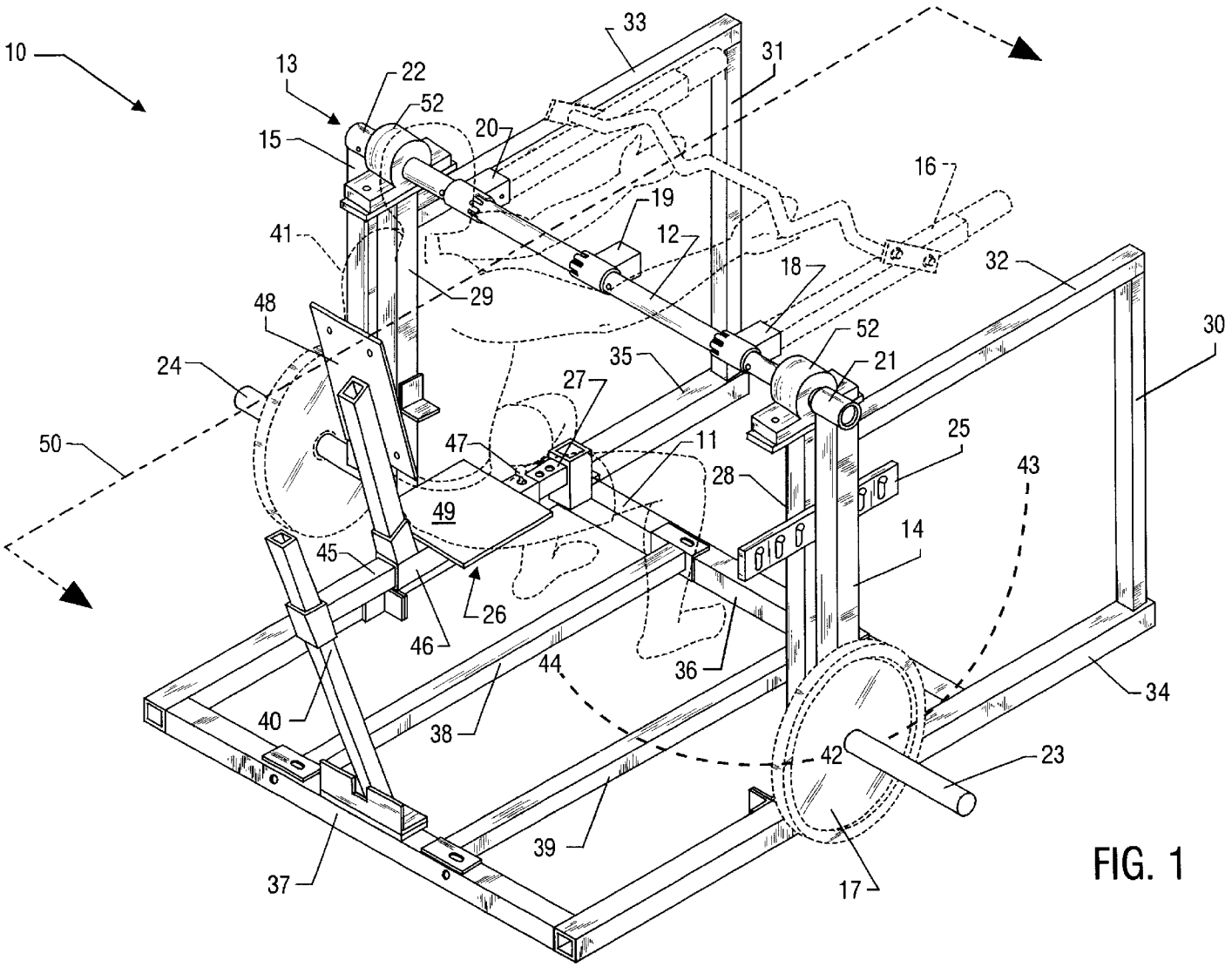
FIG. 1 is a perspective view of an exercise machine in accordance with the preferred embodiment of the invention.

FIG. 1 shows an exercise machine 10 in accordance with a preferred embodiment of the invention. With reference to FIG. 1, the machine 10 includes a support frame 11 made of a number of straight sections of heavy duty steel that are either welded or bolted together, or pivotally connected. Rotating shaft 12 is horizontally mounted on the support frame 11 by pillow block bearings 52 for rotation around it longitudinal axis 13.

A pair of weight arms 14 and 15 are connected to the shaft 12 at opposite ends thereof and extend substantially perpendicular to the longitudinal axis of the shaft 13. The lower ends of the weight arms 14 and 15 include hubs 23 and 24, respectively, which are adapted to hold one or more removable weights 17 at a point distant from their respective connections to the shaft 12. Work arm 16 is connected to the shaft 12 at a point intermediate of said connections between the weight arms 14 and 15 and the shaft 12. Work arm 16 is an example of the different types of work arms that may be employed. The work arm is adapted for actuation by an exerciser, whereby the weight arms 14 and 15, upon actuation of the work arm 16 by an exerciser 41, is moved in an arcuate path relative to the longitudinal axis of the shaft 13 from a first position 42 to a second position 43 or 44.

The exercise machine may be fabricated from any material that provides enough strength and support to support the weight carried by the machine and which will endure the strain over the range of motion exerted by the exerciser 41. The machine of the preferred embodiment is constructed of straight sections of heavy duty steel that may be either welded or bolted together, or pivotally connected. Because the machine does not require levers, pulleys, cables, or other specialized components, it is relatively simple and inexpensive to manufacture. Further, assembly of the machine is easy and not time intensive. Thus, the machine 10 can be offered at a decreased cost to the exerciser.

The support frame 11 includes bottom side supports 34 and 35, and bottom front and back supports 36 and 37. The frame also has two bottom supports 38 and 39 which connect the front and back supports 36 and 37 and which are parallel and at points intermediate of bottom side supports 34 and 35. These support pieces may be either welded together or provided with metal end sections that are bolted at the connection points.

The support frame 11 also includes two pairs of upwardly extending legs 28 and 30, 29 and 31 from bottom side supports 34 and 35, respectively. These legs 28 and 30, 29 and 31 are connected at the opposite end by top supports 32 and 33, which are parallel to bottom side supports 34 and 35. The upward ends of legs 28 and 29 extend slightly beyond the top supports 32 and 33, and support the pillow block bearings 52 supporting the shaft 12. From the perspective of an exerciser 41, supported on the seat 26, the left side of the machine includes back leg 29 and front leg 31. The right side of the machine includes back leg 28 and front leg 30. The back pair of legs 28 and 29 have reward ends connected to an intermediate point on the bottom side supports 34 and 35, respectively, which connection is in back of the connection of the bottom side supports 34 and 35 to the bottom front support 36. The bottom side supports 34 and 35 extend beyond the connection with the bottom front support 36. The front ends of bottom side supports 34 and 35 are connected to the rearward ends of front legs 30 and 31. The upward ends of front legs 30 and 31 are connected to the front ends of top supports 32 and 33, respectively. The back ends of top supports 32 and 33 are connected slightly below the upward ends of back legs 28 and 29. The frame 11 is symmetric with respect to central vertical plane 50 that extends through the center of the machine 10.

The frame 11 also includes seat supports 40 and 45. Seat support 40 connects to the bottom back support 37 in between the connections of bottom supports 38 and 39. Seat support 40 extends upward at an angle away from the bottom front support 36. The back end of seat support 45 connects to seat support 40 at a point slightly below its upward end and extends horizontally toward the bottom front support 36, parallel with the bottom side supports 34 and 35. The front end of seat support 45 has several holes on its upward edge 27 that is adapted for the placement of a pin 47. The base 46 of seat 26 fits around seat support 45 and is adjustable backwards and forwards on seat support 45 to allow placement of a pin 47 in one of the holes 27. Thus, the machine 10 allows for exercisers of different sizes to reach the work arms 16 from a seated position. The seat 26 includes a bottom support 49 and a back support 48.

Weight arms 14 and 15 are connected to the opposite ends of the shaft 12 and extend substantially perpendicular to the longitudinal axis of the shaft 13. The lower ends of the weight arms 14 and 15 include hubs 23 and 24, respectively, which are adapted to hold one or more removable weights 17. By adding removable weights 17, the exerciser 41 can change the difficulty of his workout. Alternately, weight arms 14 and 15 could have a fixed weight.

The work arm 16 can be releasably connected to the shaft 12 at one of three connections of adjustable receivers 18, 19 and 20. Work arm connection 19 is located at a point intermediate of the connections 21 and 22 between the weight arms 14 and 15 and the shaft 12. Work arm connection 18 is at a point intermediate of work arm connection 19 and connection 21, and work arm connection 20 is at a point intermediate of work arm connection 19 and connection 22. The work arm 16 is adapted for actuation by exerciser 41 such that, when the exerciser pushes or pulls the work arm, the shaft 12 rotates about its longitudinal axis, and the weight arms 14 and 15 move in an arcuate path, from a first position 42 to a second position 44 or 43 which is clockwise or counterclockwise of first position 42, respectively. The work arm 16 can be adapted to facilitate different exercises such as lat pull down, military press, chest press, tricep extension, seated dips, bicep curl, low row, lying leg press, squats, dead lifts, abdominal crunches, leg extension, seated leg curl, lat pull over, etc. Further, more than one work arm 16 may be used interchangeably to provide different types of exercises. Thus, by changing the work arm 16, the machine 10 is able to provide a variety of different exercises to an exerciser 41 who is located at substantially the same position on the machine.

Figure 2:
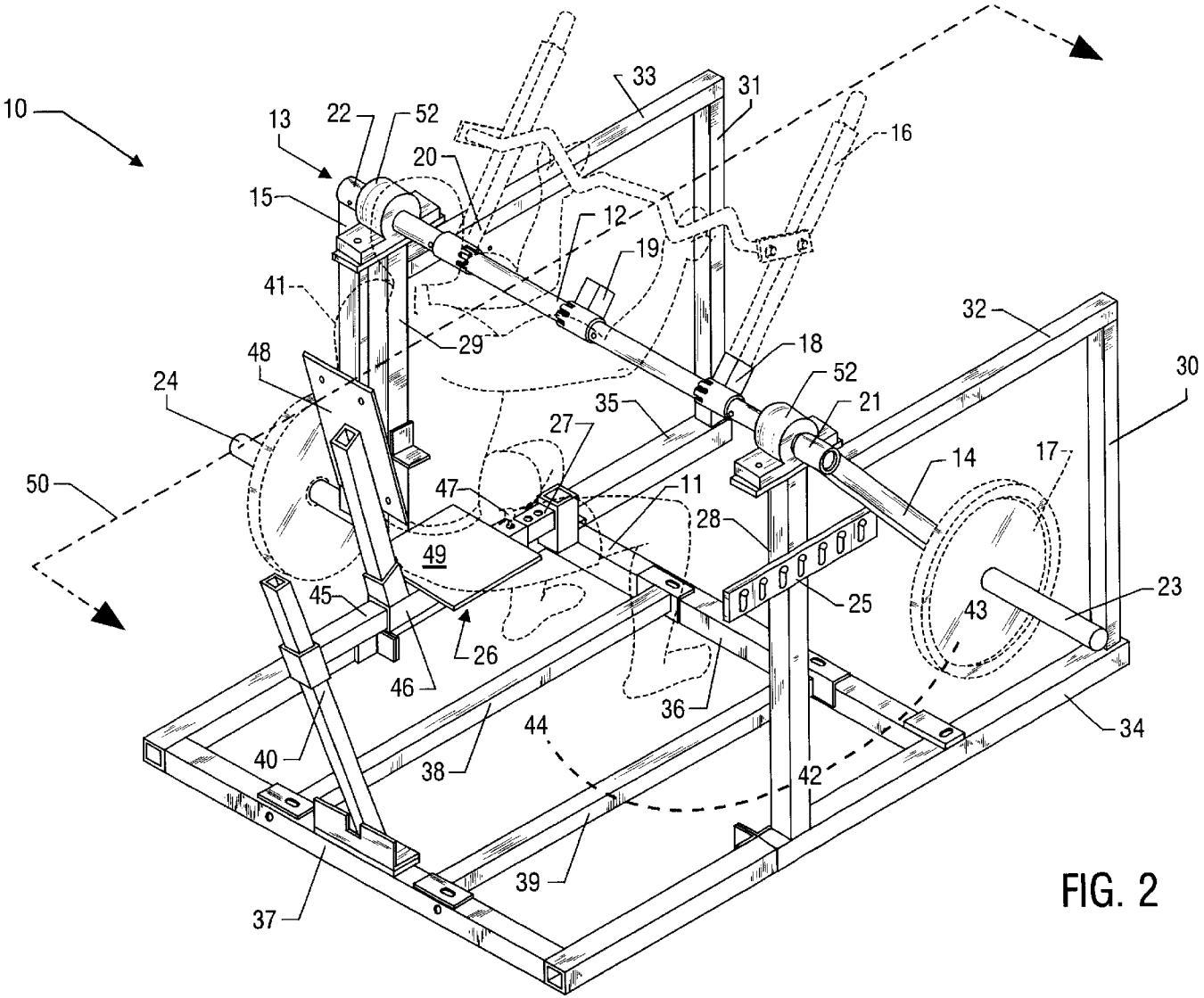
FIG. 2 is a perspective view of the exercise machine in FIG. 1 in which the weight arms have moved in a counterclockwise direction.

When an exerciser 41 is in the seated position, the shaft 12 will be directly in front of him. The exerciser will use the work arm 16 to rotate the shaft 12 about its longitudinal axis 13. This causes the weight arms 14 and 15, hubs 23 and 24, and any removable weight 17 to move in an arcuate path. Normally, the weight arms 14 and 15 will have a first or resting position that is substantially vertical 42. As shown in FIG. 2, as the exerciser 41 pulls on the work arm 16 the weight arms 14 and 15, hubs 23 and 24, and any removable weight 17 will travel in a counterclockwise direction to a second position, such as 43. Similarly, as the exerciser 41 pushes on the work arm 16 the weight arms 14 and 15, hubs 23 and 24, and any removable weight 17 will travel in a clockwise direction to a second position, such as 44. Thus, the machine 10 restricts the range of motion of an exercise and offers increased safety. The construction of the machine 10 prevents the exerciser 41 from becoming pinned or trapped beneath the weight.

The resistance to the exerciser 41 varies as the weight arms 14 and 15 move in an arcuate manner. When the weight arms 14 and 15 are in a substantially vertical position, as shown in FIG. 1, the resistance to the exerciser 41 is quite small. As the exerciser pulls or pushes the work arm 16, the weight arms 14 and 15, hubs 23 and 24, and any removable weight 17, obtain an increased downward force component, which increases the resistance to the exerciser 41. The exerciser 41 will feel the most resistance when the weight arms 14 and 15 are in a substantially horizontal position. Finally, as the exerciser 41 causes the weight arms 14 and 15 to continue in the arcuate path past the horizontal position, the downward force component will decrease and the resistance to the exerciser 41 will decrease. It will be appreciated, therefore, that the exercise machine 10 offers variable resistance to an exerciser 41 over the course of an exercise.

The machine also allows the exerciser 41 to adjust the first or starting position of the weight arms 14 and 15, which in turn allows the exerciser 41 to alter the starting resistance of the exercise. Back leg 28 includes a flat metal plate 25 welded to its outside edge. The metal plate 25 has several holes into which a pin may be inserted. An exerciser 41 can insert a pin into these holes to alter the first or starting position. The weight arm 14, will rest on the pin which will prevent the weight arm 14 from returning to a substantially vertical position. Accordingly, the invention provides an exerciser 41 with a wide variety of exercises at varying difficulties. The exerciser 41 has discretion on the starting resistance, the direction of rotation, and the amount of resistance over the movement during an isolated exercise.

While a preferred embodiment of this invention has been described, it is to be understood that the invention is not limited thereby and that in light of the present disclosure, various other alternative embodiments will be apparent to a person of ordinary skill in the art.

For example, work arm 16 may be fixed to the rotating shaft 12. Thus, the machine will provide a decreased number of exercises. In such a case, several machines may be used in conjunction, each with different work arms, to provide exerciser 41 with a multistation workout.

In a further example, the machine 10 may have more than one rotating shaft 12. Several shafts could be connected together by bearings or the like to allow for a greater range of motion. Further, removable weight 17 could be fixed to hubs 23 and 24 and be non-removable.

As shown by these examples, but not limited thereby, it is to be understood that changes may be made without departing from the scope of the invention as particularly set forth and claimed.

What is claimed is:

1. An exercise machine comprising:

a support frame;

a shaft horizontally mounted in a fixed, predetermined position on said support frame for rotation about its longitudinal axis;

a pair of weight arms connected to and extending from said shaft at opposite ends thereof in a direction substantially perpendicular to said longitudinal axis of said shaft, each of said weight arms having a weight hub for carrying at least one weight at a point distant from their respective connections to said rotating shaft; and a work arm connected to and extending from said shaft at a point intermediate of and spaced from said connections between said weight arms and said shaft, said work arm being adapted for actuation by an exerciser, and whereby said weights, upon actuation of said work arm by an exerciser, are moved in arcuate paths relative to said longitudinal axis of said shaft from respective first positions to second positions;

whereby the resistance to rotation provided by said weight arms varies as said weight arms travel in an arcuate direction; and further comprising at least one support for selectively supporting at least one of said weight arms in a substantially non-vertical position and preventing rotation of said shaft in a direction to orient said at least one weight arm in a substantially downward, vertical position and permitting free rotation of said shaft in a second direction away from said at least one support.

2. The exercise machine of claim 1, wherein said shaft is mounted on said frame by pillow block bearings.

3. The exercise machine of claim 1, wherein said work arm is releasably connected to said shaft by adjustable receivers.

4. The exercise machine of claim 1, wherein said first position of said weight arm is substantially vertical.

5. The exercise machine of claim 1, wherein said second position is clockwise of said first position.

6. The exercise machine of claim 1, wherein said second position is counter-clockwise of said first position.

7. The exercise machine of claim 1, further comprising a seat mounted on said support frame behind said shaft.

8. The exercise machine of claim 7, wherein said seat is adjustable and removable relative to said support frame.

9. The exercise machine of claim 3, wherein said work arm is a work arm for performing bicep curls.

* * * * *